US007770755B2

(12) United States Patent
Arghyris et al.

(10) Patent No.: US 7,770,755 B2
(45) Date of Patent: Aug. 10, 2010

(54) DEVICE FOR DISPENSING SEVERAL FLUIDS COMPRISING AT LEAST TWO FLEXIBLE BAGS AND TWO PUMPS

(75) Inventors: Laurent Arghyris, Boege (FR); Patrice Puviland, La Roche Sur Foron (FR); Jean-Philippe Taberlet, Villard (FR)

(73) Assignee: Lablabo, Annemasse (FR)

( * ) Notice: Subject to any disclaimer, the term of this patent is extended or adjusted under 35 U.S.C. 154(b) by 879 days.

(21) Appl. No.: 10/516,001

(22) PCT Filed: Jun. 17, 2003

(86) PCT No.: PCT/FR03/01830

§ 371 (c)(1),
(2), (4) Date: Nov. 29, 2004

(87) PCT Pub. No.: WO03/106044

PCT Pub. Date: Dec. 24, 2003

(65) Prior Publication Data

US 2005/0211724 A1 Sep. 29, 2005

(30) Foreign Application Priority Data

Jun. 18, 2002 (FR) ..... 02 07487

(51) Int. Cl.
*B05B 11/00* (2006.01)

(52) U.S. Cl. ..... 222/94; 222/135; 222/144.5; 239/305

(58) Field of Classification Search ..... 222/383.1, 222/321.1, 321.4, 321.7–321.9, 94, 105, 222/129, 135, 137, 372, 376, 385, 144.5; 239/303–305
See application file for complete search history.

(56) References Cited

U.S. PATENT DOCUMENTS

| | | | | |
|---|---|---|---|---|
| 4,662,541 | A | 5/1987 | Fossati | |
| 4,711,375 | A | 12/1987 | Mader et al. | |
| 5,411,176 | A | 5/1995 | Favre | |
| 5,740,947 | A * | 4/1998 | Flaig et al. | 222/135 |
| 5,862,947 | A * | 1/1999 | Wiegner et al. | 222/82 |
| 6,196,421 | B1 * | 3/2001 | Williams | 222/129 |
| 6,736,288 | B1 * | 5/2004 | Green | 222/94 |
| 2002/0158081 | A1 * | 10/2002 | Nir | 222/94 |
| 2003/0160071 | A1 * | 8/2003 | Moore et al. | 222/321.7 |

FOREIGN PATENT DOCUMENTS

| | | |
|---|---|---|
| FR | 2 686 807 | 8/1993 |

OTHER PUBLICATIONS

Patent Abstracts of Japan, vol. 018, No. 544, Oct. 18, 1994.
Search Report issued in International Application No. PCT/FR03/01830.

* cited by examiner

*Primary Examiner*—J. Casimer Jacyna
(74) *Attorney, Agent, or Firm*—Merchant & Gould LLC

(57) ABSTRACT

A device for packaging and dispensing several fluid products is described. The device includes at least two sealed flexible gags arranged in a single rigid container, associated with at least one pump, the rigid container consisting of an open cylinder and the bags are provided each with a pump and a push button, and are mounted opposite on each of the two opposite openings of the cylinder. The device is applicable to appliances containing fluids to be dispensed independently of one another.

14 Claims, 2 Drawing Sheets

DEVICE FOR DISPENSING SEVERAL FLUIDS COMPRISING AT LEAST TWO FLEXIBLE BAGS AND TWO PUMPS

BACKGROUND OF THE INVENTION

1. Field of the Invention

The present invention relates to a novel device for packaging and dispensing fluid products, and more particularly a device for packaging and dispensing fluid, liquid or pasty products, of the type comprising at least two flexible bags placed in the same rigid container and associated with at least two pumps, for separately storing, satisfactorily efficiently, at least two fluid products, protected from the air, and for dispensing them separately.

2. Description of the Related Art

In the fluid-product-distribution field, multi-compartment dispensers that make it possible to store several products separately, to prevent them reacting with one another for example, so that they are not mixed until they are used, are known. Thus, application WO 99/64319 describes a simple device for dispensing two fluids simultaneously by means of a double pump, more particularly for toothpastes or gels. This device has an upper part mounted telescopically on a lower part, forming a pump with two pistons that move in parallel in two cylinders that are integral with the lower part. Each time the upper part forming a push-button is pressed, variable amounts of products are expelled. Such a device is therefore not suitable when it is necessary to dispense predetermined, constant amounts of products.

Also known are devices for separately dispensing two or more fluid products, as selected by the user. For example, French patent application 01/16246, in the name of the applicant, describes a device of the pocket-flask type comprising two bags placed in parallel in the same flask, associated with two extraction pumps and one or two push-buttons for actuating the pumps. When the device comprises only a single push-button, this push-button acts simultaneously on the two pumps and the products exiting from each of the two bags are mixed in the dispensing head. In a variant, this device comprises two independent push-buttons, each acting on one pump such that the user is able to choose to actuate only one of the two push-buttons in order to dispense the fluid of his/her choice. However, the two push-buttons are placed alongside one another and the user may confuse them and erroneously actuate one instead of the other or accidentally press the second push-button while actuating the first one if his/her finger is not suitably placed on the first push-button.

In point of fact, it is often desirable to be able to offer the user a device containing at least two products that are packaged separately but can be dispensed independently of one another with minimal risk of confusion.

The applicant observed that this objective could be achieved by appropriately associating certain extraction pumps for fluid products associated with bags and with a rigid container of the pocket-flask type.

Fluid-packaging and -dispensing devices of this type are well known. They generally comprise a container with a rigid shell in which is placed a flexible bag that contracts as the product is extracted from it. The product may be expelled from the bag using an airless pump, or by being pressurized by a propellant gas acting on the wall of the bag in the flask. In the case of expulsion of product outside the bag using an airless pump, a vent is provided, generally in the base or neck of the flask, to allow external air to enter the space between the flask and the bag each time the pump is actuated, thus allowing the bag to contract while maintaining sufficient pressure on its walls. An illustrative embodiment using this technique is described in patent FR 2.723.356, which relates to a device comprising a bag made from flexible plastic, such as polyethylene or polypropylene, in a rigid container whose neck has an air inlet.

SUMMARY OF THE INVENTION

A subject of the present invention is precisely a device for packaging and dispensing fluid, liquid or pasty products, of the type comprising at least two sealed flexible bags placed in the same single rigid container and associated with at least two pumps, for efficient dispensing of both products separately.

A subject of the invention is also a device for packaging and dispensing several fluid products each contained in a separate bag, making the bags very easy to fill without the need for complex or specially designed equipment.

A subject of the invention is also a device for packaging and dispensing several fluid products, of the type comprising at least two sealed flexible bags placed in the same single rigid container, ensuring perfect packaging of the product by means of excellent sealing of the bags and pumps.

Finally, a subject of the invention is a device of the type stated above, which can be manufactured profitably.

The device for packaging and dispensing fluid products according to the present invention is of the type comprising at least two sealed flexible bags placed in the same single rigid container and associated with at least one pump, and it is noteworthy in that the rigid container consists of an open cylinder and the bags are each equipped with a pump and with a push-button and are mounted in opposition on each opening of the cylinder.

DETAILED DESCRIPTION OF PREFERRED EMBODIMENTS

Figure 1:
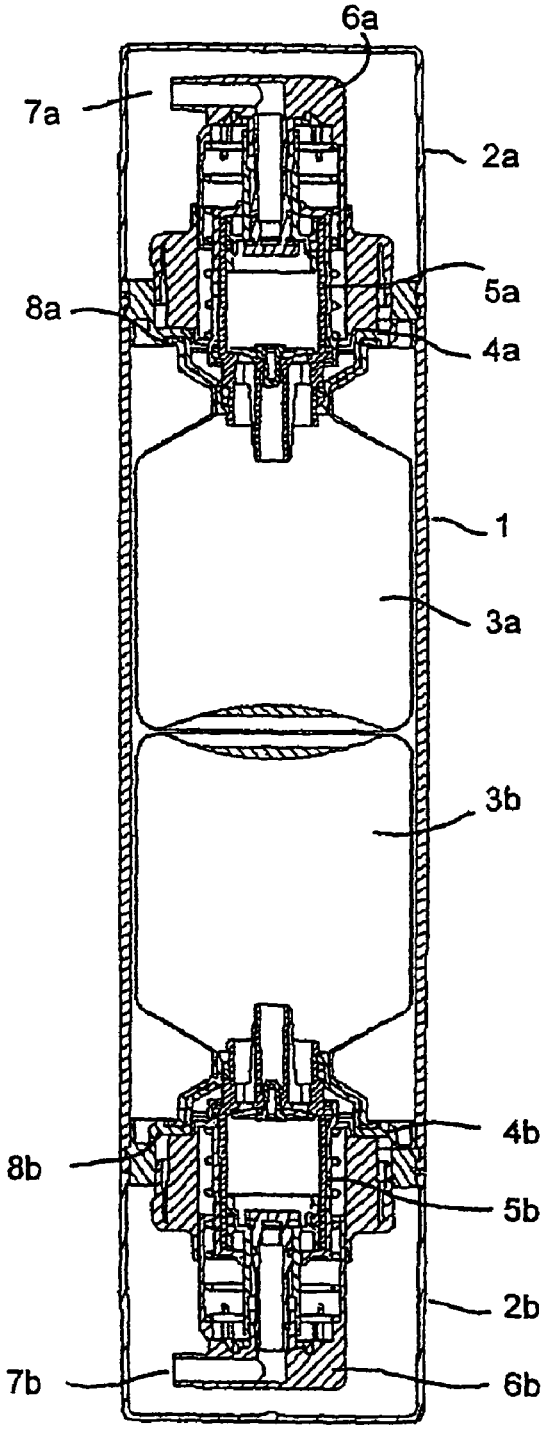
FIG. 1 is a diagrammatic sectional view of an assembly comprising two bags, and their respective pump and push-button, retained by a ring, and mounted in opposition on the same rigid container.

Several non-limiting illustrative embodiments of suitable bags and flasks forming devices for packaging and dispensing two fluids according to the present invention, are described in more detail below, with reference to the appended drawings.

According to an advantageous embodiment, the bags are fastened via their neck on the openings of the rigid container, each bag is fastened on each of the two opposite openings of the cylindrical rigid container, and, preferably, the bags are fastened to the container by means of a ring. It may be advantageous to make provision for the ring to be incorporated into the neck of the bag.

According to one embodiment of the invention, the cylinder forming the rigid container is monobloc, and a bag is fastened to each of its openings.

According to another embodiment, the cylinder consists of two cylindrical elements assembled end to end.

As stated above, the open cylinder forming the rigid container may be produced as a single component or as two components, for example as two cylinders assembled via their bases, by means of adhesive bonding, snap-fitting, screwing, welding or any other appropriate fastening means. The cylinder forming the rigid container may have any cross section, for example a circular or polygonal cross section.

One of the advantages of the present invention is that the bags may have any shape, to suit that of the rigid container. Advantageously, the bags, and the rigid container containing them, have a cylindrical shape on a polygonal, elliptical or circular base. A cylindrical shape of this type may easily be produced, as stated below, by blow molding or injection-blow molding the bag, and using this technique the shape of the bag may be adapted to that of the rigid container, which means that losses in volume are minimized.

The pumps used in the invention are pumps of the airless type, as commonly used in the field. These pumps are generally produced from plastic, such as polyethylene or polypropylene.

The pumps are preferably double-valve pumps, which means they are well-sealed and function satisfactorily irrespective of the position of the rigid container. Thus, the pump generally comprises a first valve at the entry to the metering chamber and a second valve at the exit, for example at the entry to the evacuation duct.

As stated above, each bag is preferably fastened to the container by means of a ring, to which it is conventionally fastened, for example by nesting, by adhesive bonding or by welding. According to one embodiment, the ring and the bag may be made as a single component.

The plastics used to produce the bags may be chosen, for example, from among a polyethylene, a polypropylene, a polyamide, an ethylene/vinyl alcohol (EVOH) copolymer, a low-density polyethylene, etc. They may consist of single-layer materials or multilayer complexes including a metal layer, for example a layer of aluminum forming a barrier that reinforces sealing, combined with one or more layers of plastic. The bag may be produced using these materials by methods such as injection-blow molding or extrusion-blow molding of a pre-form in a suitable mold. The bag may also be produced by welding a plastic or metal film or a multilayer metal/plastic complex to a support forming the neck of the bag.

According to an advantageous variant embodiment of the invention, each bag is produced from a material suited to the product it contains, and the device may thus comprise at least two bags formed from different materials. By way of example, the first bag may be produced from low-density polyethylene and contain a cream that is not very sensitive to the effects of the external environment, while the second bag contains a more fragile product and may be produced from a polyamide, thereby obtaining better protection against the effects of oxygen and against evaporation loss of water vapor.

The material used for the ring may be a plastic of the same nature as that used for the bag, but treated so as to make it sufficiently rigid, for example by using a greater thickness of material. Thus, polyethylene or polypropylene rings may be used, and the ring and the bags may be produced as a single component, by injection-blow molding or any other suitable method. The rigid container may be produced from plastic or from any other suitable rigid material. For example, rigid containers may be made from polyethylene, polyethylene terephthalate (PET) acrylonitrile butadiene styrene (ABS), glass or a metal such as aluminum or an aluminum alloy.

According to the present invention, two identical bags, or bags of different volumes may be used together, the metering chamber of each pump then being preferably adapted to the volume of the corresponding bag. For example, the metering chamber of each pump may be proportional to the volume of the corresponding bag. This is particularly advantageous in the case of the dispensing of complementary fluid products that must be mixed in certain quantities. Thus, a device with a rigid container and two flexible bags, each communicating with a pump, according to the invention may be adapted to the ratio of mixing of the two products contained in the bags, and if this ratio must be 2/1, for example, the volume of the second bag can be made to be half that of the first, and likewise for the volume of the metering chamber of the second pump with respect to the first.

Furthermore, as the bags are placed contiguously via their base in the same rigid container, the volume of the latter is fully used, with no dead volume, even if the bags have different volumes.

As for all devices of the pocket-flask type, an external air intake is provided in the form of a vent or an air suction circuit so that the bags are able to contract inside the rigid container.

According to a simple embodiment, the vent is provided in the wall of the rigid container, and it may be equipped with a valve and/or a filter. One or more vents may be provided.

According to a preferred embodiment, the air circuit consists of a passage made in the rim of the fastening ring of each of the pumps, communicating with the space between the pumps and the push-button.

The air circuit, allowing external air to enter the volume between the wall of the rigid container and the bags, is preferably designed to remain closed while the fluid is stored in each bag and to open only each time the pumps are actuated so as to allow only a volume of air equivalent to the volume of fluid expelled from each bag to enter. When the pumps cease to be actuated, the air circuit is automatically closed, thus ensuring optimum preservation of the products contained in the bags by limiting evaporation through the wall of the bags. It thus comprises closure means closing off the circuit while the pumps are not actuated. For example, the air circuit may comprise closure means consisting of valves that remain closed while the pump is not actuated.

The two-bag device according to the present invention has the advantage of being easy to fill without it being necessary to use complex equipment. It is possible to fill the two bags simultaneously, to place the pumps on each bag, and then to place each of the full bags on the rigid container, or conversely to fasten the two bags on the rigid container, preferably by means of rings, to fill the first bag and to fasten the corresponding pump, and then to fill the second bag and to fasten the second pump after having inverted the device. According to the present invention, filling may be carried out using standard equipment, simply using gravity, thus ensuring very regular filling.

Various wordings and illustrations may be affixed to the bag or to the rigid container, for example by printing or screen-printing, depending on the envisioned use.

As it is used and the products contained in it are extracted, each bag contracts steadily, limiting the risks of splitting or tearing.

The rate of release of the product, i.e. the ratio between the volume of product introduced into the bag during filling and the volume extracted during use, is excellent, and may be greater than 90%.

The device according to the present invention is particularly useful in areas of application in which two products have to be used separately, for example alternately, as in the case of cosmetic or dermatological compositions, such as creams and gels, when it may be useful to use a first product at one specific time and a second product at another time, for example a day cream and a night cream. In such an example of use, it is most particularly advantageous to be able clearly to differentiate between the packaging through the use of different colors, not only for the push-buttons, but also for those parts of the rigid container that correspond to each bag volume. It is also possible to produce one part of the rigid container in an opaque material and the other in a translucent or transparent material, especially when the container is formed by assembling two cylinders via their bases.

Figure 2:
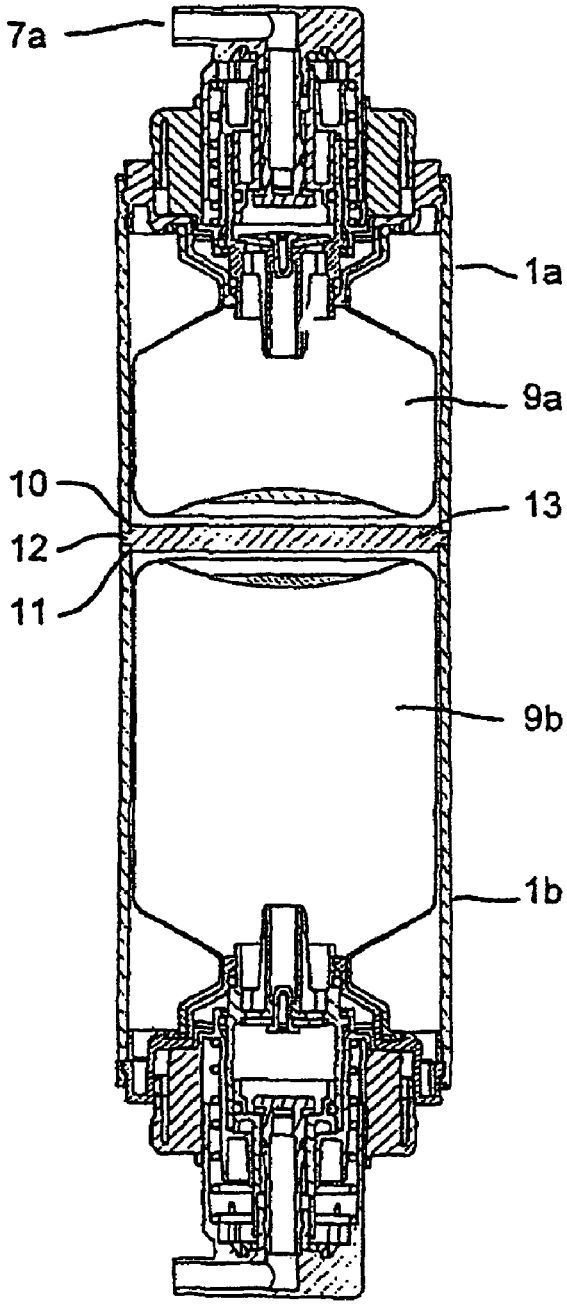
FIG. 2 is a sectional view of a variant of the device of FIG. 1, comprising bags of different volumes in a rigid container consisting of two open cylinders assembled via their base.

Several non-limiting illustrative embodiments of suitable bags and flasks forming devices for packaging and dispensing two fluids according to the present invention, are described in more detail below, with reference to the appended drawings, which show:

FIG. 1: a diagrammatic sectional view of an assembly comprising two bags, and their respective pump and push-button, retained by a ring, and mounted in opposition on the same rigid container;

FIG. 2: a sectional view of a variant of the device of FIG. 1, comprising bags of different volumes in a rigid container consisting of two open cylinders assembled via their base.

The device of the pocket-flask type shown in FIG. 1 comprises a rigid container (1) of cylindrical shape of which the two ends are concealed by two caps (2*a*, 2*b*). The rigid container (1) and the caps (2*a*, 2*b*) are produced from polypropylene. Two flexible bags (3*a*, 3*b*) made from polypropylene and produced by injection-blow molding are inserted into the container (1) to which they are fastened by means of rings (4*a*, 4*b*).

The rings are secured to the wall of the container (1) by means of a known method, for example by nesting by virtue of a rib on the periphery of each ring interacting with a groove formed in the internal wall of the container. The bags are assembled with the rings by nesting of their neck in the central hole of the ring, in a known manner.

A pump (5*a*, 5*b*) of the airless type is placed on the neck of each bag, by means of nesting in accordance with a conventional method. Each of these pumps may be actuated by a push-button (6*a*, 6*b*), an exit nozzle (7*a*, 7*b*) being provided for expelling the product whenever the pumps are actuated when the caps (2*a*, 2*b*) have been removed by the user.

An air-intake circuit (8*a*, 8*b*) is provided on the rim of each ring (4*a*, 4*b*) so that air can enter the volume between the bags and the internal wall of the rigid container (1) whenever one or other of the push-buttons is actuated.

In order to use the device, the user removes one or other of the two caps (2*a*, 2*b*) and presses the corresponding push-button in order to obtain the product of his/her choice, which exits from one or other of the two bags (3*a*) or (3*b*).

As shown in FIG. 2, the container (1) may be formed of two cylinders (1*a*, 1*b*) of the same diameter. The cylinder (1*a*) contains the bag (9*a*) of smaller volume than the bag (9*b*) contained in the cylinder (1*b*).

The two cylinders (1*a*, 1*b*) are assembled via their base, by nesting, by virtue of grooves (10, 11) at the base of the cylinder (1*a*) and of the cylinder (1*b*), respectively, interacting with an annular rib (12) provided on the rim of the reinforcement disk (13) placed between the bags. The disk (13) helps to keep the whole in place.

Preferably, each of the two cylinders (1*a*) and (1*b*) is in a different color in order clearly to identify the two products contained in the bags.

The invention claimed is:

1. A device for packaging and dispensing fluid products, of the type comprising at least two sealed flexible bags placed in the same single rigid container and at least two pumps, wherein the rigid container consists of an open cylinder having a cylindrical wall and two opposite openings and the bags are each equipped with a pump and with a push-button and are mounted in opposition on each opening of the cylinder, and wherein the bags are fastened to the container by means of a ring; and an air circuit configured to provide external air to a volume between the cylindrical wall of the rigid container and the bags and consisting of a passage made in a rim of a fastening ring of each of the pumps, communicating with the space between the pumps and the push-button, and wherein it comprises closure means closing the circuit when the pumps are not actuated, wherein at least one bag is fastened on each of the two opposite openings of the cylindrical rigid container.

2. The device as claimed in claim 1, wherein the bags are fastened via their neck on the openings of the rigid container.

3. The device as claimed in claim 1, wherein it comprises at least two bags formed from different materials adapted to the product contained in each bag.

4. The device as claimed in claim 1, wherein the bags are produced by injection-blow molding or extrusion-blow molding a material chosen from among a polyethylene, a polypropylene, a polyamide, an ethylene/vinyl alcohol (EVOH) copolymer, and a low density polyethylene.

5. The device as claimed in claim 1, wherein the bags are produced by welding a plastic or metal film or a multilayer metal/plastic complex on a support forming the neck of the bag.

6. The device as claimed in claim 1, wherein the ring is incorporated into the neck of the bag.

7. The device as claimed in claim 1, wherein the cylinder forming the rigid container is monobloc.

8. The device as claimed in claim 1, wherein the cylinder consists of two elements assembled end to end.

9. The device as claimed in claim 8, wherein the two elements are assembled via their base by means of adhesive bonding, snap-fitting, screwing or welding.

10. The device as claimed in claim 1, wherein it comprises two bags of different volumes.

11. The device as claimed in claim 1, wherein the metering chamber of each pump is proportional to the volume of the corresponding bag.

12. The device as claimed in claim 1, wherein the bags, and the rigid container containing them, have a cylindrical shape on a polygonal, elliptical or circular base.

13. The device as claimed in claim 1, wherein the air circuit opens each time the pumps are actuated so as to allow only a volume of air equivalent to the volume of fluid expelled from each bag to enter.

14. The device as claimed in claim 1, comprising two sealed flexible bags and two pumps, wherein a bag is fastened on each of the two opposite openings of the cylindrical rigid container.

* * * * *